United States Patent [19]

Moore, Jr.

[11] 4,078,343

[45] Mar. 14, 1978

[54] MOBILE HOME ENCLOSURE

[76] Inventor: Augustus Beamon Moore, Jr., P.O. Box 96, Wilmington, N.C. 28401

[21] Appl. No.: 762,840

[22] Filed: Jan. 27, 1977

[51] Int. Cl.[2] ..... E04H 1/02

[52] U.S. Cl. ..... 52/79.1; 52/168; 52/185; 52/236.3; 169/62

[58] Field of Search ..... 52/64, 168, 67, 143, 52/79.3, 741, 79.1, 745, 79.2, 185, 236.3; 239/208, 209; 169/62; 296/23 R, 23 MC

[56] References Cited

U.S. PATENT DOCUMENTS

| | | | |
|---|---|---|---|
| 1,079,152 | 11/1913 | Stentzel | 52/169 X |
| 2,499,498 | 3/1950 | Hammond, Jr. | 52/67 |
| 2,527,012 | 10/1950 | Kinsman | 52/143 X |
| 2,840,866 | 7/1958 | Paulsen | 52/67 |
| 2,893,066 | 7/1959 | Perdue | 296/23 R X |
| 3,016,583 | 1/1962 | Grunt et al. | 52/67 X |
| 3,492,767 | 2/1970 | Pincus | 52/79.1 |
| 3,612,589 | 10/1971 | Locher, Jr. | 296/23 R |
| 3,678,639 | 7/1972 | Panitz | 52/79.1 |
| 3,769,765 | 11/1973 | Wright | 52/143 X |
| 3,993,139 | 11/1976 | Vaughn | 239/209 X |

FOREIGN PATENT DOCUMENTS

| | | | |
|---|---|---|---|
| 1,152,526 | 8/1963 | Germany | 52/236.3 |

OTHER PUBLICATIONS

House and Home, "What's So Good About Splits?" Feb. 1955, p. 145.

*Primary Examiner*—Leslie Braun

[57] ABSTRACT

A single, bi-level or multi-level structure is built having a foundation; spaced, parallel side walls extending upwardly therefrom; a roof connecting the upper edges of the side walls; and a horizontal partition extending between the side walls divides the structure beneath the roof and is initially left open, through which a mobile home is subsequently introduced into the structure to complete the lower level. The distance between the side walls is preferably greater than the width of the mobile home, and an inner wall or partition extends the length of the structure between one of the outer walls and the mobile home, whereby storage space, a separate entranceway, and a flight of stairs to the upper level may be provided. The mobile home itself includes a special floor plan and a higher ceiling space than in conventional mobile home units, into which a sprinkler system and heating and air conditioning ductwork is installed.

5 Claims, 9 Drawing Figures

MOBILE HOME ENCLOSURE

BACKGROUND OF THE INVENTION

Mobile homes have existed as an alternative to conventional homes and apartments for quite some time. For a good part of that time, they enjoyed considerable success and provided persons with a comfortable home in which some equity could be accumulated for a modest investment. As the cost of permanent housing and land increased, the popularity and economic feasibility of mobile homes at the outset became quite an attractive alternative. However, zoning laws and building codes in recent years have prevented mobile homes from ultimately obtaining the success which they should enjoy.

Today it is almost impossible to locate a mobile home in any kind of desirable neighborhood convenient to many urban facilities because of such zoning laws. Moreover, several characteristics of existing types of mobile homes now tend to limit sales to low income families. Such characteristics include the tin box look, ghetto-type park developments as well as hazards from wind and fire, all stigmatizing the image of good basic construction despite compliance with UL, national, state and local building codes.

SUMMARY OF THE INVENTION

The present invention is therefore directed to the provision of low-cost, easy-to-erect housing which provides an attractive, economically feasible alternative to apartment dwellings or low-cost housing, while at the same time overcoming the mobile home stigma and enabling an owner to locate the mobile home in desirable residential neighborhoods. The dwelling of the present invention provides a structure having the appearance of a permanent dwelling, yet the major portion of the living area is in reality a mobile home disguised within a shell-type structure which includes a foundation, side walls, a roof, and an upper story. The permanent portion can be decorated according to any desired motif with wood, brick, siding, shingles, windows and the like, while the main living area of the dwelling may be prefabricated, and selectively moved into position within the shell, and removed if the owner is relocated. All of these objectives are achieved without disturbing the real property per se of the shell-type structure.

Further, the shell includes an inner partition, extending longitudinally of the structure and providing an enclosed space between the outer wall and mobile home for building a set of stairs to an upper level, as well as storage and utility room space.

At least a portion of one end of the permanent structure beneath the roof is left open so that the mobile home may be selectively moved into and out of position within the shell. After positioning of the mobile home, removable closure panels, filler strips, or even a detachable porch may be installed into the end portions, all of which can be later removed to permit removal of the mobile home therefrom if desired.

With these thoughts in mind, it is therefore an object of the present invention to provide an attractive but economical structure utilizing a mobile home within a permanent-appearing residence.

It is another object of the present invention to provide a dwelling which, while appearing to be permanent includes a major portion thereof which is prefabricated as a mobile home and is selectively positionable and removable therefrom.

Another primary object of the present invention is to provide a residence which includes, at least as a major portion thereof, a mobile home module protected from fire and wind; yet having, in no way, the appearance of a mobile home in order to escape the inevitable stigma of having to place a mobile home in an undesirable neighborhood due to its past lack of aesthetic association.

Also, there is an object to provide an economical dwelling with privacy in the normal urban environment and to conserve energy costs by encasing one unit within another unit for the improved insulation value.

Other objects, and a fuller understanding of the invention will become apparent from a consideration of the following detailed description taken in connection with the accompanying drawings, in which.

DETAILED DESCRIPTION OF A PREFERRED EMBODIMENT

Figure 1:
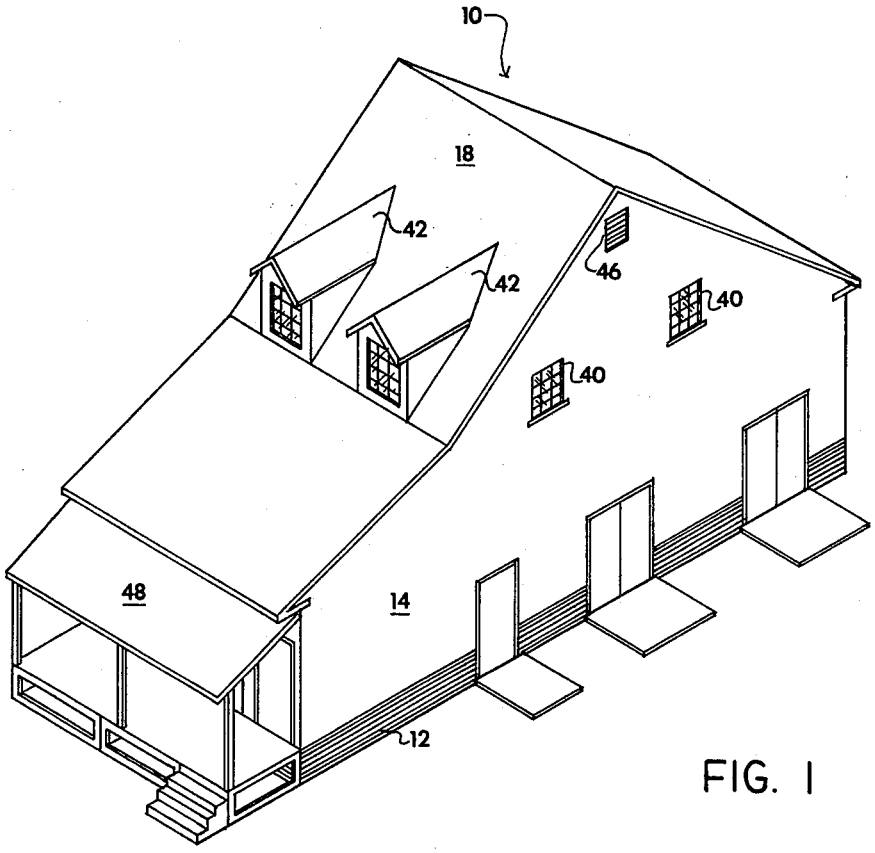
FIG. 1 is a perspective view of the mobile home structure, according to the present invention, looking at the front corner of the structure.
Figure 2:
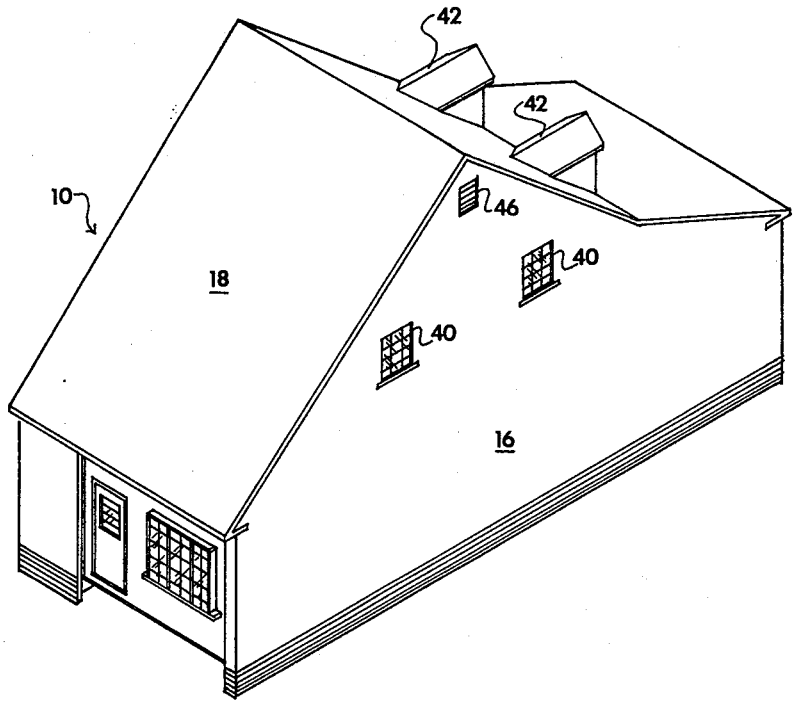
FIG. 2 is a perspective view of the mobile home structure illustrated in FIG. 1, except looking at the rear corner thereof.

Referring now to FIGS. 1 and 2, and in general, the present invention is directed to the combination of a frame structure 10 and a prefabricated mobile home with some minor modifications thereto. The frame structure 10 includes a foundation 12, side walls 14,16, a roof 18, and a horizontal floor or partition 20 which divides the structure to an upper level with a space therebelow which is enclosed at least on the sides. At least a portion of one end of the frame structure is open through which a prefabricated mobile home is introduced into the structure to form a lower level. The distance between the side walls 14,16 is preferably greater than the width of the mobile home and inner partition 22 extends between one of the outer walls and the mobile home, whereby storage space 24,26,28 and a flight of stairs 30 to the upper level U may be provided. The mobile home itself includes certain novel modifications to provide a higher ceiling spacing than conventional into which a sprinkler system and heating and air conditioning ductwork is installed.

Turning now to a description of the frame itself, and referring to FIGS. 1–5, the foundation 12, the side walls 14,16, and the roof 18 are all formed in accordance with conventional practices concerning the erection of permanent or prefabricated residences. For example, after a conventional foundation 12 is formed, the side walls 14,16 may be constructed by erecting conventional studwork covered with aluminum siding as illustrated, or with brick or frame. The roof is then constructed conventionally. Windows 40, dormers 42, roof pitch changes, ventilator grills 46, and the like may all be provided if and where desired. A porch 48 or other decorative facades may be positioned at one end of the side walls beneath the roof as illustrated in FIG. 1. At the outset, the other or rear end of the frame structure, beneath the roof is left open for introduction of the mobile home as will be described hereinafter.

A horizontally extending floor partition 20 extends between the side walls at a point approximately 10–12 feet above the ground to divide the frame structure into an upper and lower level.

The upper level is then divided, by means of vertical partitions 41, into a living area 42, a bath 44, closet spaces 47,49, and a kitchen unit 50, or any other desired room arrangement. The upper level may either be utilized as a separate upstairs apartment, or in connection with the main floor formed by the mobile home therebeneath as additional living space.

Figure 5:
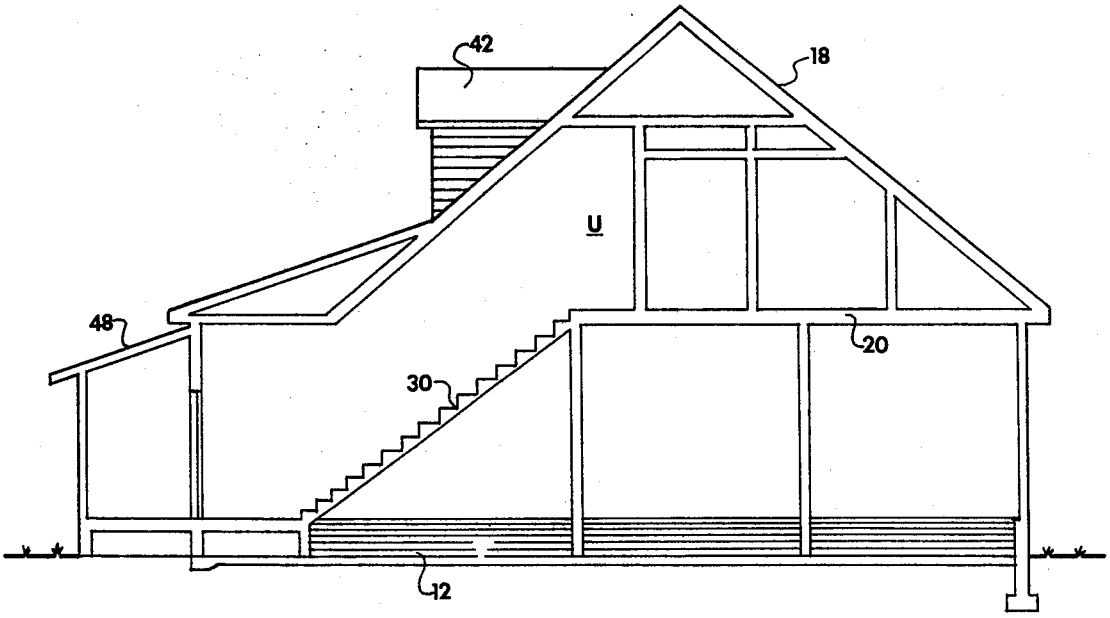
FIG. 5 is a longitudinal sectional view taken substantially along lines 5—5 in FIGS. 3 and 4.

As illustrated in FIG. 5, the distance between outer walls 14,16 is preferably approximately 4–5 feet wider than the width of the mobile home, and an inner, longitudinally extending vertical partition 22 extends the length of the frame in the lower level. A plurality of storage rooms 24, 26, 28 accessible from the outside are provided between side wall 14 and partition 22. In addition, a flight of steps 30 leading up to the upper level is positioned between side wall 14 and partition 22. An entrance opening or doorway 52 is provided at the front end of the space between the side wall 14 and partition 22 to provide separate access to the upper level U.

The structure 10 described hereinabove forms the permanent portion of the residence, and upon or near completion, a prefabricated mobile home is towed, pushed, or otherwise introduced into the lower level. Side walls 14,16 as well as partition 22 are preferably as long as, or slightly longer than, the length of mobile home M, so that the mobile home is completely contained within the structure 10. So arranged within the structure, the mobile home 10 is protected from the weather elements such as wind, hail, rain and the like. Moreover, the mobile home is completely disguised, and therefore unobjectionable as far as zoning laws, historical districts, and other land uses are concerned. A conventional plug-in utility panel 54 connects water and other utilities to the mobile home, while the water and utilities for the upper living area are permanently constructed with the residence portion.

Figure 6:
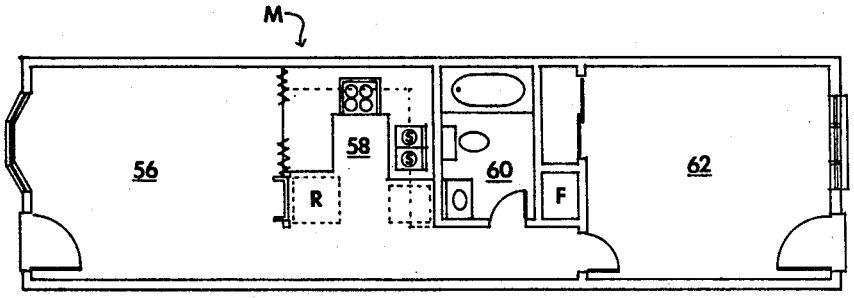
FIG. 6 is a plan view of the mobile home which is to be inserted within the permanent portion of the structure illustrated in FIGS. 3 and 4.
Figure 7:
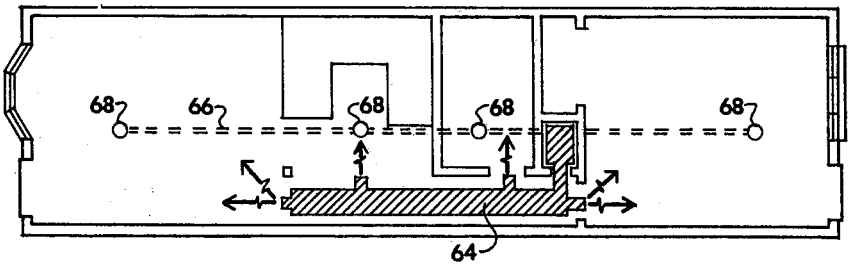
FIG. 7 is a plan view of the heating and air conditioning ductwork of the mobile home according to the present invention.
Figure 8:
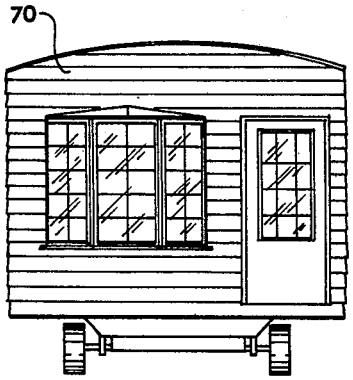
FIG. 8 is a front elevation view of the mobile home itself.
Figure 9:
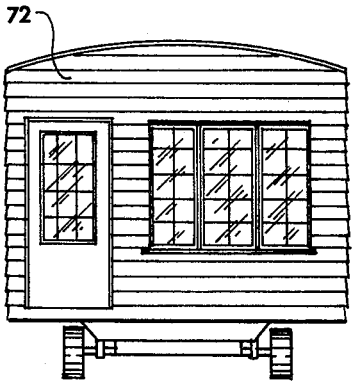
FIG. 9 is a rear elevation view of the mobile home illustrated in FIG. 8.

Turning now to FIG. 6, the mobile home itself is divided up into a living room 56, kitchen 58, bath 60, and bedroom 62 as well as suitable cedar-lined closet space and storage area. Some slight, yet significant and unique modifications are made to the conventional mobile home, in that the roof is raised to provide at least 8 feet of standard unit modular construction type space between the floor and ceiling within, and to provide an area above the ceiling for the heating and air conditioning ductwork 64 and a sprinkler system 66 which includes sprinkler heads 68 at spaced positions along the length of the inner portion of the mobile home. The sprinkler heads are automatically activated in the event fire breaks out or the temperature otherwise rises above the prescribed level in order to obtain reduced fire rates in an urban environment.

The front end 70 and rear end 72 of the mobile home are attractively decorated as illustrated in FIGS. 1 and 2, to blend in inconspicuously with the decor of the frame structure 10. Similar siding, window types, door, and other accessories are provided on the front and rear end of the mobile home M to capture the character of indigenous and permanent architecture. Additionally, the entrances of the mobile home are provided at the front and rear end, rather than on the side as is conventional. After the mobile home M is inserted within the lower level of the structure 10, auxiliary closure panels 74 may be provided to extend between side wall 16 and the front and rear ends of partition 22, so that the decorative effect of the front and rear of the completed structure is continuous thereacross.

Figure 3:
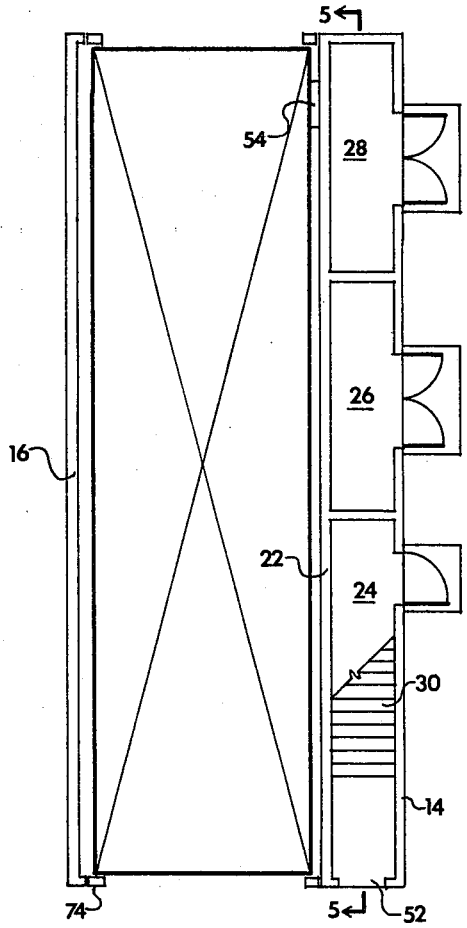
FIG. 3 is a plan view of the lower level of the permanent portion of the structure with the mobile home position shown.
Figure 4:
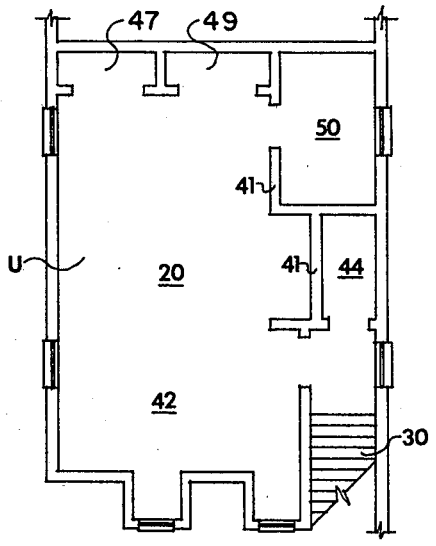
FIG. 4 is a plan view of the upper level of the structure.

As is illustrated in FIGS. 1 and 3, separate front doors are provided for the mobile home and the entrance way to the upper level. In cases where an owner would utilize the upper level as expansion space for his mobile home below, a single door could be provided in either the mobile home or in the front end of structure 10, and an opening (not shown) would be formed through the corresponding front portion of the side wall of the mobile home and partition 22 to permit communication of the occupants between the lower level and upper level.

The aforedescribed mobile home enclosure thereby combines the appearance and zoning advantages of a permanent residence as real property with the economies, flexibility and tax advantages of a mobile home as personal property. Moreover, the mobile home itself is protected from outside elements, particularly wind damage; contains its own fire extinguishing system; and moves the heating and air conditioning ductwork up into the ceiling above the occupants' head, thereby providing more usable space down below. An owner may purchase the frame as a permanent residence, insert a mobile home therein to provide both a lower level apartment and an upper, smaller garage-type apartment, or may connect the two areas to provide a somewhat larger bi-level residence. The prefabrication of the mobile home portion lends considerable economy to the construction of the dwelling to the extent that construction costs are cut by 30–50%.

The features of the invention pertaining to the mobile home module itself may be utilized in other types of mobile homes to provide more space because of the transfer of the ductwork into the ceiling area, and to provide a safer mobile home because of the sprinkler system and to minimize energy and plumbing costs. Other changes and modifications may be made to the embodiment described in the detail hereinabove without departing from the scope of the invention, which is to be limited only by the following claims:

What is claimed is:

1. An improved building structure housing two independent living areas, said structure comprising:

a. a permanent shell forming the first of said two independent areas and having:

i. a foundation;

ii. a pair of spaced, parallel side walls extending upwardly from said foundation and supporting a roof between the upper edges thereof;

iii. a horizontal floor panel extending between said side walls at a level intermediate said roof and said foundation, means for enclosing the space above the floor panel at the ends thereof, thereby forming the space beneath said roof and between said side walls into an upper and lower portion;

iv. a self-contained separate living area above said horizontal floor panel having at least kitchen, bathroom and sleeping facilities therein;

v. said side walls spaced apart a distance greater than the width of said mobile home, and further including a longitudinally extending, vertical partition arranged in parallel spaced relationship with one of said side walls, between said one side wall and said mobile home to form a space therebetween in which a set of stairs from the outside are provided;

b. a self-contained, conventionally available mobile home forming the second of said two independent areas and including end walls, side walls, a floor and ceiling, and kitchen, bathroom, and sleeping facilities therein, said mobile home being removably positioned beneath said horizontal floor panel between said vertical partition and the other of said side walls;

c. said shell and mobile home having separate entrances.

2. The structure according to claim 1 wherein said side walls are at least as long as said mobile home.

3. The structure according to claim 1 wherein an entrance is provided to said mobile home in at least one of said end walls of said mobile home.

4. The building structure according to claim 1 wherein said mobile home comprises a sprinkler system installed in the ceiling thereof, said sprinkler system being automatically activated when the heat therein rises above a prescribed level.

5. The structure according to claim 1 wherein said mobile home includes a heating and air conditioning ductwork, said ductwork being arranged adjacent the ceiling of said mobile home rather than along the walls or in the floor.

* * * * *